US008016001B2

(12) United States Patent
Yamasaki et al.

(10) Patent No.: US 8,016,001 B2
(45) Date of Patent: Sep. 13, 2011

(54) PAINTING MATERIAL CHARGING DEVICE

(75) Inventors: Isamu Yamasaki, Toyota (JP); Takanobu Mori, Toyota (JP); Shinichi Nakane, Toyota (JP); Noriyuki Achiwa, Toyota (JP); Kohta Harada, Toyota (JP)

(73) Assignees: Toyota Jidosha Kabushiki Kaisha, Toyota-shi (JP); Trinity Industrial Corp., Toyota-shi (JP)

( * ) Notice: Subject to any disclaimer, the term of this patent is extended or adjusted under 35 U.S.C. 154(b) by 5 days.

(21) Appl. No.: 12/675,669

(22) PCT Filed: Aug. 28, 2008

(86) PCT No.: PCT/JP2008/065446

§ 371 (c)(1),
(2), (4) Date: Feb. 26, 2010

(87) PCT Pub. No.: WO2009/028623

PCT Pub. Date: Mar. 5, 2009

(65) Prior Publication Data

US 2010/0212774 A1 Aug. 26, 2010

(30) Foreign Application Priority Data

Aug. 31, 2007 (JP) ..... 2007-225131

(51) Int. Cl.
*B65B 1/30* (2006.01)
*B05C 11/00* (2006.01)
*B08B 9/00* (2006.01)

(52) U.S. Cl. ..... 141/21; 141/18; 141/67; 141/94; 141/302; 118/688; 427/421.1; 134/169 C

(58) Field of Classification Search ..... 141/18, 141/21, 67, 94, 104, 192, 302; 134/166 R, 134/169 C; 118/602, 603, 664, 676, 688; 239/694; 427/421.1
See application file for complete search history.

(56) References Cited

U.S. PATENT DOCUMENTS 4,313,475 A * 2/1982 Wiggins ..... 141/18
5,293,911 A * 3/1994 Akeel ..... 141/346
6,071,346 A * 6/2000 Yamauchi et al. ..... 118/668
6,077,354 A 6/2000 Kaneski et al.

(Continued)

FOREIGN PATENT DOCUMENTS

DE 43 39 302 A1 5/1995

(Continued)

OTHER PUBLICATIONS

Office Action mailed May 24, 2011 in TW97133356 and partial translation thereof. (The references cited in this Office Action have already been submitted with an IDS Feb. 26, 2010.)

(Continued)

*Primary Examiner* — Timothy L Maust
(74) *Attorney, Agent, or Firm* — Kenyon & Kenyon LLP

(57) ABSTRACT

A painting material charging device may comprise a cartridge attaching unit, a painting material supplying path, a first switching unit, a painting material supplying unit, a discharging path, a second switching unit, a painting material sensor and a controlling unit. The controlling unit may be configured to be connected to the painting material sensor and the second switching unit. The controlling unit may be configured to cause the second switching unit to fully close the discharging path in a case where the painting material sensor detects the painting material.

7 Claims, 5 Drawing Sheets

U.S. PATENT DOCUMENTS

| | | | | |
|---|---|---|---|---|
| 6,253,800 | B1 | 7/2001 | Yoshida et al. | |
| 6,582,774 | B2 * | 6/2003 | Klein et al. | 427/427 |
| 6,612,345 | B1 * | 9/2003 | Hosoda et al. | 141/20.5 |
| 6,630,025 | B2 * | 10/2003 | Nonomura et al. | 118/300 |
| 6,705,361 | B2 * | 3/2004 | Niederquell et al. | 141/198 |
| 7,066,186 | B2 * | 6/2006 | Bahr | 134/56 R |
| 7,549,449 | B2 * | 6/2009 | Herre et al. | 141/91 |

FOREIGN PATENT DOCUMENTS

| | | | |
|---|---|---|---|
| DE | 43 42 128 | A1 | 6/1995 |
| EP | 1 095 707 | A2 | 5/2001 |
| EP | 1 566 221 | A2 | 8/2005 |
| EP | 1 897 622 | A1 | 3/2008 |
| EP | 2 095 879 | A1 | 9/2009 |
| FR | 2 719 790 | A1 | 11/1995 |
| JP | 2000-176328 | A | 6/2000 |
| JP | 2001-219110 | A | 8/2001 |
| JP | 2007-055841 | A | 3/2007 |
| JP | 2007-69133 | A | 3/2007 |
| JP | 2007-98389 | A | 4/2007 |
| WO | 97/34707 | A1 | 3/1997 |
| WO | WO 2006/132305 | A1 | 12/2006 |
| WO | 2011/048489 | A1 | 4/2011 |

OTHER PUBLICATIONS

Extended EP Search Report mailed Jul. 7, 2011.

* cited by examiner

PAINTING MATERIAL CHARGING DEVICE

This is a 371 national phase application of PCT/JP2008/065446 filed 28 Aug. 2008, which claims priority of Japanese Patent Application No. 2007-225131 filed 31 Aug. 2007, the contents of which are incorporated herein by reference.

TECHNICAL FIELD

The present invention relates to a painting material charging device which charges a painting material in a painting material cartridge.

BACKGROUND ART

A painting device for painting the body or the like of a vehicle is known. The painting device paints by using a painting material in a painting material cartridge attached to the painting device. The painting material cartridge is capable of being repeatedly charged with the painting material. The painting material charging device is used for re-charging the painting material in the painting material cartridge (e.g., see Patent Document 1).

The painting material charging device of Patent Document 1 has a painting material supplying unit, a cartridge attaching unit, and a painting material supplying path. When charging the painting material in the painting material cartridge, the painting material cartridge is attached to the cartridge attaching unit. The painting material supplied from the painting material supplying unit is charged in the painting material cartridge through the painting material supplying path.

Patent Document 1: Japanese Patent Application Publication No. 2000-176328

DISCLOSURE OF THE INVENTION

Problem to be Solved by the Invention

In a case where the painting material supplying path has air therein at the time of charging the painting material in the painting material cartridge, the air gets entrapped into the painting material cartridge. For this reason, before charging the painting material in the painting material cartridge, it is necessary to carry out an air-releasing process of supplying the painting material into the painting material supplying path and extruding the air of the painting material supplying path using the painting material.

In the air-releasing process, the greater the force of the painting material supplied to the painting material supplying path, the shorter the time required for the air-releasing process becomes. However, such force of the painting material supplied to the painting material supplying path being great, the amount of painting material to be discharged to the outside of the painting material supplying path along with the air becomes greater. That is, a large amount of painting material is discharged unnecessarily since after the air has been completely extruded from the painting material supplying path and starting to discharge the painting material until stopping the supply of the painting material.

The present invention has been contrived in view of the above circumstances, and an object thereof is to provide a technology for reducing the amount of painting material discarded through the air-releasing process in a painting material charging device.

Means to Solve the Problem

A painting material charging device disclosed in this application comprises a cartridge attaching unit, a painting material supplying path, a first switching unit, a painting material supplying unit, a discharging path, a second switching unit, a painting material sensor and a controlling unit. The cartridge attaching unit is configured to attach and detach a painting material cartridge. The painting material supplying path is configured to connect with the painting material cartridge attached to the cartridge attaching unit. The first switching unit is configured to switch between connecting and disconnecting the painting material supplying path and the painting material cartridge attached to the cartridge attaching unit. The painting material supplying unit is configured to supply a painting material to the painting material supplying path. The discharging path is configured to connect with the painting material supplying path. The second switching unit is configured to switch the discharging path between a fully opened state and a fully closed state. The painting material sensor is configured to detect the painting material within the discharging path. The controlling unit is configured to be connected to the painting material sensor and the second switching unit. The controlling unit is configured to cause the second switching unit to fully close the discharging path in a case where the painting material sensor detects the painting material.

In this painting material charging device, the air-releasing process is carried out by causing the first switching unit to disconnect the painting material supplying path and the painting material cartridge, causing the second switching unit to bring the discharging path into a fully opened state, and causing the painting material supplying unit to supply the painting material to the painting material supplying path. The air within the painting material supplying path is extruded to the discharging path by the painting material. After the air within the painting material supplying path is extruded completely, the painting material subsequently flows into the discharging path. The painting material that flows into the discharging path is detected by the painting material sensor. In a case where the painting material sensor detects the painting material, the second switching unit immediately switches the state of the discharging path into a fully closed state. At this timing, the air-releasing process is completed.

According to this painting material charging device, the completion of the air-releasing process is precisely detected by the painting material sensor, and unnecessary discharge of the painting material is stopped immediately. As a result, the amount of painting material to be wasted through the air-releasing process can be reduced.

In this painting material charging device, the second switching unit may be further configured to switch the discharging path to a partially closed state in which the discharging path is in part closed. The controlling unit may be configured to cause the second switching unit to keep the partially closed state in a case where the painting material supplying path and the painting material cartridge are disconnected by the first switching unit and the painting material sensor does not detect the painting material.

According to this configuration, during the air-releasing process, the discharging path can be partially closed. By partially closing the discharging path, resistance loaded on the painting material which has flown into the discharging path becomes high. As a result, the flow rate of the painting material can be reduced significantly, when the painting material flows into the discharging path. Note that in a case where the remaining painting material in the painting material supplying path is discharged or the painting supplying path is cleansed with washing liquid, the second switching unit can be caused to bring the discharging path into the fully opened state.

According to this painting material charging device, the amount of painting material to be wasted through the air-releasing process can be reduced.

The second switching unit may comprise a first valve configured to switch the discharging path between the fully opened state and the fully closed state, and a second valve configured to switch the discharging path between the fully opened state and the partially closed state.

Accordingly, the second switching unit which switches the state of the discharging path between the fully opened state, the fully closed state, and the partially closed state can be provided with a simple configuration.

In this painting material charging device, an area of the discharging path in the partially closed state by the second switching unit may be equal to or smaller than 1/10 (one-tenth) of an area of the discharging path in the fully opened state.

According to this configuration, the flow rate of the painting material within the discharging path can be reduced more effectively.

In this painting material charging device, the painting material sensor may be located at an upstream side of the second switching unit.

The fact that the painting material flows into the discharging path can be detected more quickly, by disposing the painting material sensor in the vicinity of the painting material supplying path. Therefore, the second switching unit can be switched to the closed state at an earlier stage, and the amount of painting material discharged to the outside of the painting material supplying path can be reduced.

This painting material charging device may comprise a washing liquid supplying unit configured to supply washing liquid to the painting material supplying path. In this case, the controlling unit may be configured to cause the second switching unit to keep the discharging path in the fully opened state while the washing liquid supplying unit is supplying the washing liquid to the discharging path even in a case where the painting material sensor detects the painting material.

According to this painting material charging device, a washing process for washing the painting material supplying path can be carried out by causing the first switching unit to disconnect the painting material supplying path and the painting material cartridge, the second switching unit to bring the discharging path into the fully opened state, and the washing liquid supplying unit to supply the washing liquid to the painting material supplying path. The painting material within the painting material supplying path is extruded to the discharging path by the washing liquid. The painting material which is extruded to the discharging path is detected by the painting material sensor. In this case, the washing process cannot be performed normally, if the controlling unit brings the discharging path into the fully closed state. Unlike the air-releasing process, in the washing process it is necessary to keep the discharging path in the fully opened state even in a case where the painting material sensor detects the painting material.

In regards to the above, in this painting material charging device, the controlling unit causes the second switching unit to keep the discharging path in the fully opened state even in a case where the painting material sensor detects the painting material, while the washing liquid supplying device supplies the washing liquid to the discharging path. As a result, the washing process can be carried out normally.

This painting material charging device may comprise a timer configured to be connected to the controlling unit and to measure a time elapsed from a start of a supplying of the painting material from the painting material supplying unit. In this case, the controlling unit may be configured to cause the second switching unit to switch to the fully closed state when the time measured by the timer becomes a second predetermined time that is longer than a first predetermined time in a case where the painting material sensor has detected the painting material by when the time measured by the timer has become equal to the first predetermined time, and cause the second switching unit to switch to fully closed state in a case where the painting material sensor does not detect the painting material by when the time measured by the timer becomes a third predetermined time that is equal to or longer than the second predetermined time. Note that the first predetermined time may be zero second, and the second predetermined time may be equal to the third predetermined time.

According to this configuration, even in a case where the painting material sensor performs false detection or in a case where the painting material sensor is out of control, the air-releasing process can be carried out accurately, and the generation of a wasteful painting material can be prevented.

The present specification provides another painting material charging device capable of reducing the amount of painting material discharged to the outside of the painting material supplying path. That is, another painting material charging device comprises a cartridge attaching unit, a painting material supplying path, a first switching unit, a painting material supplying unit, a discharging path, a first valve and a second valve. The cartridge attaching unit is configured to attach and detach a painting material cartridge. The painting material supplying path is configured to connect with the painting material cartridge attached to the cartridge attaching unit. The first switching unit is configured to switch between connecting and disconnecting the painting material supplying path and the painting material cartridge attached to the cartridge attaching unit. The painting material supplying unit is configured to supply a painting material to the painting material supplying path. The discharging path is configured to connect with the painting material supplying path. The first valve is configured to switch the discharging path between a fully opened state and a fully closed state. The second valve is configured to switch the discharging path between the fully opened state and a partially closed state.

In this painting material charging device, the air-releasing process is carried out by causing the first switching unit to disconnect the painting material supplying path and the painting material cartridge, the second valve to bring the discharging path into a partially closed state, and the painting material supplying unit to supply the painting material to the painting material supplying path. The air within the painting material supplying path is extruded to the discharging path by the painting material. After the air within the painting material supplying path is extruded completely, the painting material subsequently flows into the discharging path. Once the painting material flows into the discharging path, the air-releasing is completed. In a case where the completion of the air-releasing is confirmed, the first valve brings the discharging path into the fully closed state. During the time period between the completion of air-releasing and when the completion is confirmed and the discharging path is brought into the fully closed state, the painting material is discharged.

In this painting material charging device, because the discharging path is partially closed, resistance loaded on the painting material that have flown into the discharging path becomes high, and the flow rate of the painting material after flowing into the discharging path is significantly reduced. That is, the flow rate of the painting material after the completion of the air-releasing is reduced significantly. Thus, the amount of painting material that is discharged unnecessarily can be reduced after the point of time when the air-releasing is completed.

According to this painting material charging device, the amount of painting material that is wasted through the air-releasing process can be reduced.

Effects of the Invention

According to the present invention, the amount of painting material to be wasted can be reduced by reducing the amount of painting material discharged to the outside of the painting material supplying path through the air-releasing process. As a result, the cost corresponding with the reduced amount of wasteful painting material can be cut down.

EMBODIMENTS

Some of the features of the present embodiments will be described below.

(First Feature) A painting material supplying unit supplies a plurality of types of painting materials to a painting material supplying path.

(Second Feature) A washing liquid supply device supplies both washing liquid and air to the painting material supplying path.

(Third Feature) A painting material sensor comprises a phototube.

Figure 1:
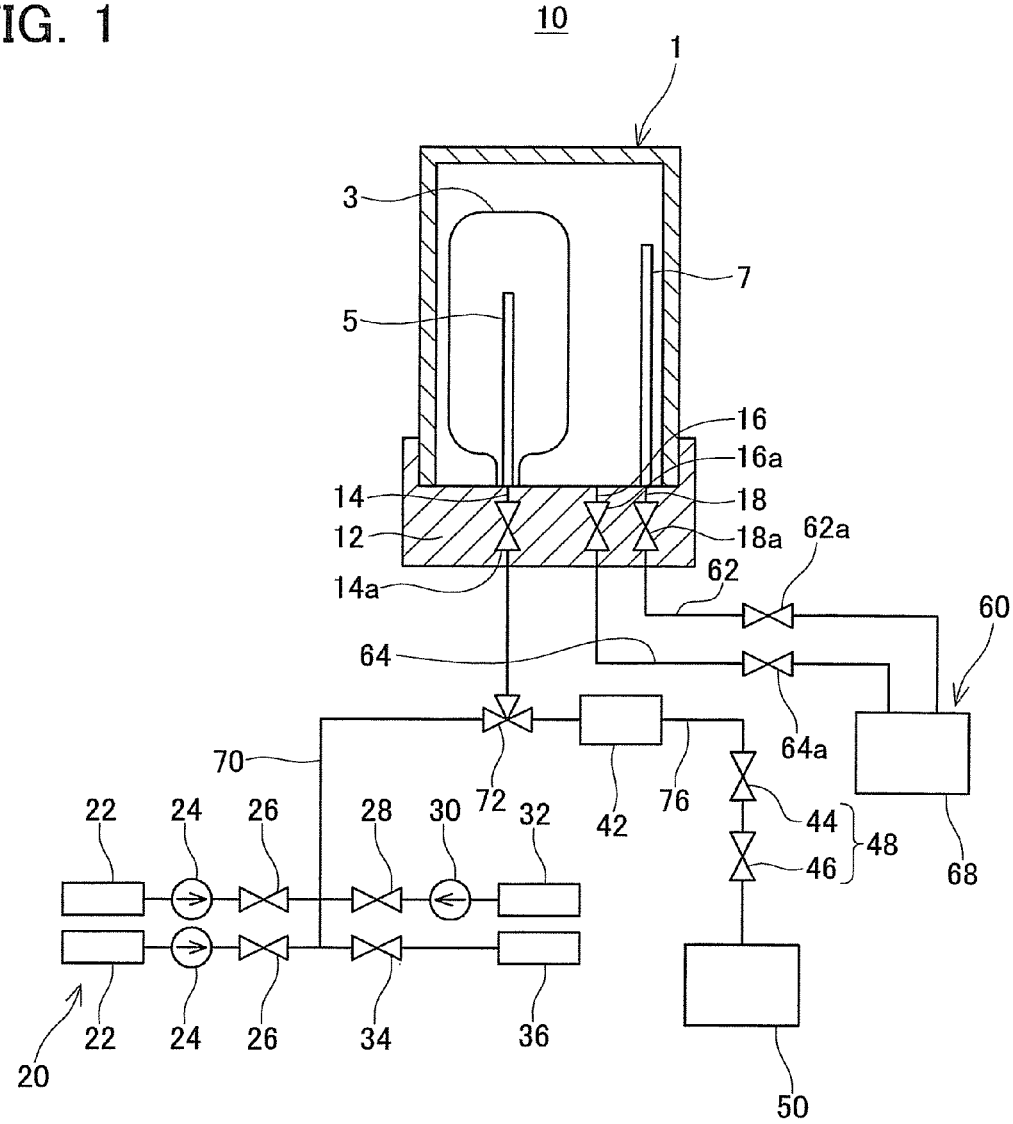
FIG. 1 is a block diagram of a configuration of a painting material charging device of a present embodiment.

A painting material charging device according to the detailed embodiments of the present invention is described with reference to the drawings. FIG. 1 shows a block diagram of a configuration of a painting material charging device 10. As shown in FIG. 1, the painting material charging device 10 comprises a cartridge attaching unit 12, a painting material supplying unit 20, a discharging path 76, and an extruding-liquid discharge device 60.

A painting material cartridge 1 can be attached to or detached from an upper surface of the cartridge attaching unit 12. FIG. 1 shows a state in which the painting material cartridge 1 is attached to the cartridge attaching unit 12. Inside the cartridge attaching unit 12, a first extruding-liquid flow path 18, a second extruding-liquid flow path 16, and a painting material flow path 14 that extend from the upper surface to a lower surface of the cartridge attaching unit 12 are formed.

The first extruding-liquid flow path 18 is formed in a position to face an extruding-liquid transferring tube 7 that is disposed outside a cartridge bag 3 within the painting material cartridge 1. The first extruding-liquid flow path 18 is connected with the extruding-liquid moving tube 7, in a condition where the painting material cartridge 1 is attached to the cartridge attaching unit 12. A stop valve 18*a* is disposed in a central part of the first extruding-liquid flow path 18.

The second extruding-liquid flow path 16 is disposed between the painting material flow path 14 and the first extruding-liquid flow path 18. The second extruding-liquid flow path 16 is connected with the painting material cartridge 1 outside the cartridge bag 3, in a condition where the painting material cartridge 1 is attached to the cartridge attaching unit 12. A stop valve 16*a* is disposed in a central part of the second extruding-liquid flow path 16.

The painting material flow path 14 is formed in a position to face a painting material moving tube 5 disposed within the cartridge bag 3 of the painting material cartridge 1. The painting material flow path 14 is connected with the painting material moving tube 5, in a condition where the painting material cartridge 1 is attached to the cartridge attaching unit 12. A stop valve 14*a* is disposed in a central part of the painting material flow path 14. Each of the stop valves 14*a*, 16*a*, 18*a* brings the respective flow path into a closed state in a case where the painting material cartridge 1 is not attached to the cartridge attaching unit 12, and brings the respective flow path into an opened state in a case where the painting material cartridge 1 is attached to the cartridge attaching unit 12. The stop valves 14*a*, 16*a*, 18*a* may be switched manually or automatically.

A trigger valve 72 (first switching unit) is connected to a lower end of the painting material flow path 14. In addition, a painting material supplying path 70 and the discharging path 76 are connected to the trigger valve 72. The trigger valve 72 switches between a state where the painting material flow path 14 and the painting material supplying path 70 are connected with each other while the painting material supplying path 70 and the discharging path 76 are disconnected, and a state where the painting material supplying path 70 and the discharging path 76 are connected with each other while the painting material supplying path 70 and the painting material flow path 14 are disconnected. The trigger valve 72 is a switch valve that is operated by a solenoid (not shown).

The painting material supplying unit 20 is connected to an end of the painting material supplying path 70, which is on the opposite side of the cartridge attaching unit 12. The painting material supplying unit 20 comprises painting material tanks 22, painting material pumps 24, and painting material valves 26. Each of the painting material tanks 22 is connected to the painting material supplying path 70 via the painting material pump 24 and painting material valve 26. Each of the painting material valves 26 switches between connecting and disconnecting the painting material supplying path 70 and respective one of the painting material tanks 22. Each of the painting material pumps 24 sends the painting material from the respective painting material tank 22 towards the painting material supplying path 70. FIG. 1 shows two sets of the painting material tank 22, the painting material pump 24 and the painting material valve 26. However, only one set may be provided, or, three or more sets may be provided. Different types of painting materials are stored in the plurality of the painting material tanks 22, respectively.

In addition to the components described above, the painting material supplying unit 20 comprises a washing liquid (e.g., thinner) tank 32, a washing liquid pump 30, a washing liquid valve 28, an air source 36, and an air valve 34. The washing liquid tank 32 is connected to the painting material supplying path 70 via the washing liquid pump 30 and the washing liquid valve 28. The washing liquid valve 28 switches between connecting and disconnecting the painting material supplying path 70 and the washing liquid tank 32. The washing liquid pump 30 sends washing liquid from the washing liquid tank 32 towards the painting material supplying path 70. The air source 36 is connected to the painting material supplying path 70 via the air valve 34. The air valve 34 switches between connecting and disconnecting the painting material supplying path 70 and the air source 36. Each of the valves 26, 28, 34 is a switch valve operated by a solenoid (not shown).

The discharging path 76 is connected to an end of the painting material supplying path 70 which is on the cartridge attaching unit 12 side, via the trigger valve 72. A painting material sensor 42 is disposed in the vicinity of the trigger valve 72 on the discharging path 76. The painting material sensor 42 detects the painting materials passing through the discharging path 76 at the point where the painting material sensor 42 is disposed. In a case where the painting material sensor 42 detects the painting materials, the painting material sensor 42 sends a signal to a controller 80 which is described hereinafter. The painting material sensor 42 is a sensor which comprises a phototube. Specifically, a part of the discharging path 76 is provided with a transmission part made of a light transmissive material, and the painting material sensor 42 is configured by a light source and the phototube which are disposed with the transmission part therebetween.

A switching unit 48 is disposed on a downstream side of the painting material sensor 42 of the discharging path 76. The switching unit 48 comprises a first discharge valve 46 (first valve) and a second discharge valve 44 (second valve). The first discharge valve 46 is disposed on the downstream side of the second discharge valve 44. The first discharge valve 46 switches the discharging path 76 between a fully opened state and a fully closed state. The second discharge valve 44 switches the discharging path 76 between a partially closed state where the discharging path 76 is partially closed, and the fully opened state. Each of the discharge valves 44, 46 is a switch valve operated by a solenoid (not shown). A waste liquid tank 50 for receiving the painting materials or washing liquid discharged from the discharging path 76 is disposed on a downstream end of the discharging path 76.

The extruding-liquid discharge device 60 is configured by a first extruding-liquid discharging path 62, a second extruding-liquid discharging path 64, and an extruding-liquid tank 68.

One end of the first extruding-liquid discharging path 62 is connected to a lower end of the first extruding-liquid flow path 18 of the cartridge attaching unit 12. The other end of the first extruding-liquid discharging path 62 is connected with the extruding-liquid tank 68. The first extruding-liquid discharging path 62 is opened and closed by a first extruding-liquid valve 62*a*. One end of the second extruding-liquid discharging path 64 is connected to a lower end of the second extruding-liquid flow path 16 of the cartridge attaching unit 12. The other end of the second extruding-liquid discharging path 64 is connected with the extruding-liquid tank 68. The second extruding-liquid discharging path 64 is opened and closed by a second extruding-liquid valve 64*a*.

Figure 2:
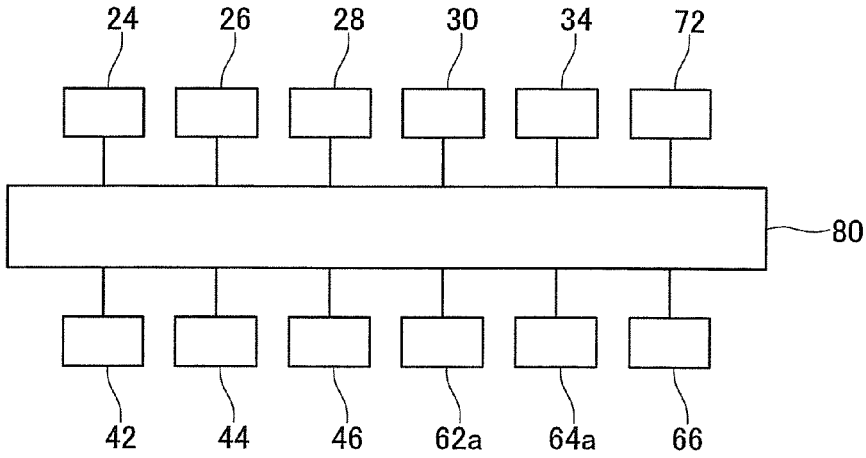
FIG. 2 is a block diagram of a control system of the painting material charging device of the present embodiment.

FIG. 2 is a block diagram of a control system of the painting material charging device 10. The painting material charging device 10 comprises the controller 80. The painting material pump 24, the painting material valve 26, the washing liquid valve 28, the washing liquid pump 30, the air valve 34, the trigger valve 72, the painting material sensor 42, the first discharge valve 46, the second discharge valve 44, the first extruding-liquid valve 62*a*, the second extruding-liquid valve 64*a*, and the timer 66 are connected to the controller 80. The controller 80 controls the operation of each of the devices connected thereto, by using a mounted CPU, memory (both not shown), and the like. The timer 66 can measure an operation time of each device.

Figure 3:
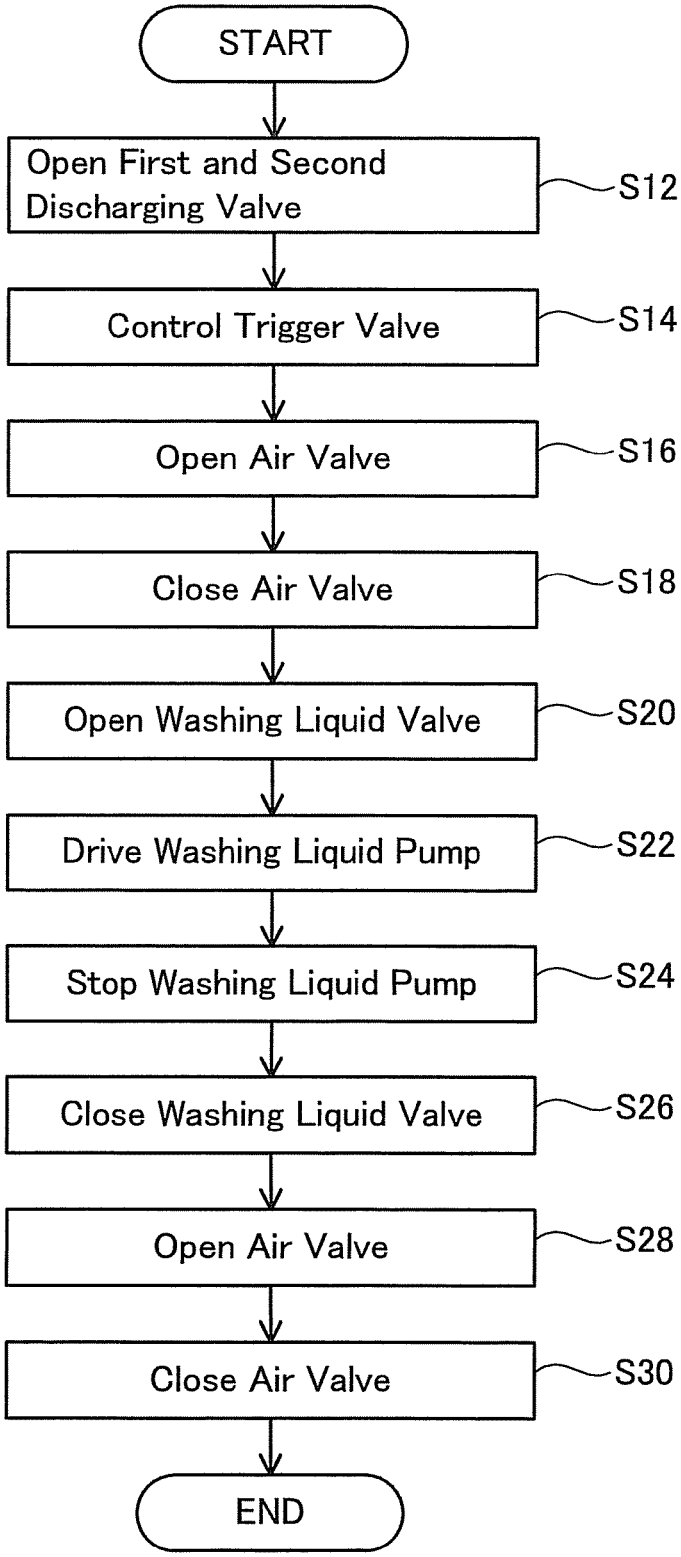
FIG. 3 is a flowchart of a control procedure performed by a controller in a washing process of the present embodiment.

Next, the operation of the painting material charging device 10 is described with reference to the drawings. First, a washing process of the painting material supplying path 70 of the painting material charging device 10 is described. FIG. 3 is a flowchart of a control procedure performed by the controller 80 in the washing process. The washing process is performed prior to a painting material charging process that is described hereinafter.

A user attaches the painting material cartridge 1 to the cartridge attaching unit 12 and brings into the washing process. Note that in the washing process, the painting material cartridge 1 may not necessarily be attached. When the washing process is started, the controller 80 opens the first discharge valve 46 and the second discharge valve 44 (step S12) to fully open the discharging path 76. In a case where the discharging path 76 is already fully opened, the controller 80 does not perform step S12. The controller 80 operates the trigger valve 72 to connect the painting material supplying path 70 and the discharging path 76 with each other, and also disconnect the painting material supplying path 70 and the painting material flow path 14 (step S14). The controller 80 does not perform step S14 in a case where the trigger valve 72 already connects the painting material supplying path 70 and the discharging path 76 with each other and the painting material supplying path 70 and the painting material flow path 14 are already disconnected. The controller 80 opens the air valve 34 to supply air to the painting material supplying path 70 (step S16). When the air valve 34 is opened, compressed air is supplied from the air source 36 to the painting material supplying path 70. The air supplied to the painting material supplying path 70 extrudes the painting materials remaining in the painting material supplying path 70 to the discharging path 76 side. The painting material extruded to the discharging path 76 is introduced to the waste liquid tank 50. After a predetermined time (e.g., 0.5 second) elapses since the air valve 34 is brought into an opened state, the controller 80 closes the air valve 34 and stops the air supply (step S18).

Next, the controller 80 opens the washing liquid valve 28 (step S20), and drives the washing liquid pump 30 (step S22). As a result, the washing liquid is supplied to the painting material supplying path 70. The washing liquid extrudes the painting materials remaining in the painting material supplying path 70 to the discharging path 76, and washes the inside of the painting material supplying path 70. The painting materials extruded to the discharging path 76 and the washing liquid are introduced to the waste liquid tank 50. After a predetermined time (e.g., 0.5 second) elapses since the washing liquid pump 30 is driven, the controller 80 stops the washing liquid pump 30 (step S24), and closes the washing liquid valve 28 (step S26). The controller 80 opens the air valve 34 (step S28) and extrudes the washing liquid within the painting material supplying path 70 to the discharging path 76. After a predetermined time (e.g., 1.0 second) elapses since the air valve 34 is opened, the controller 80 closes the air valve 34 (step S30) and ends the washing process.

Figure 4:
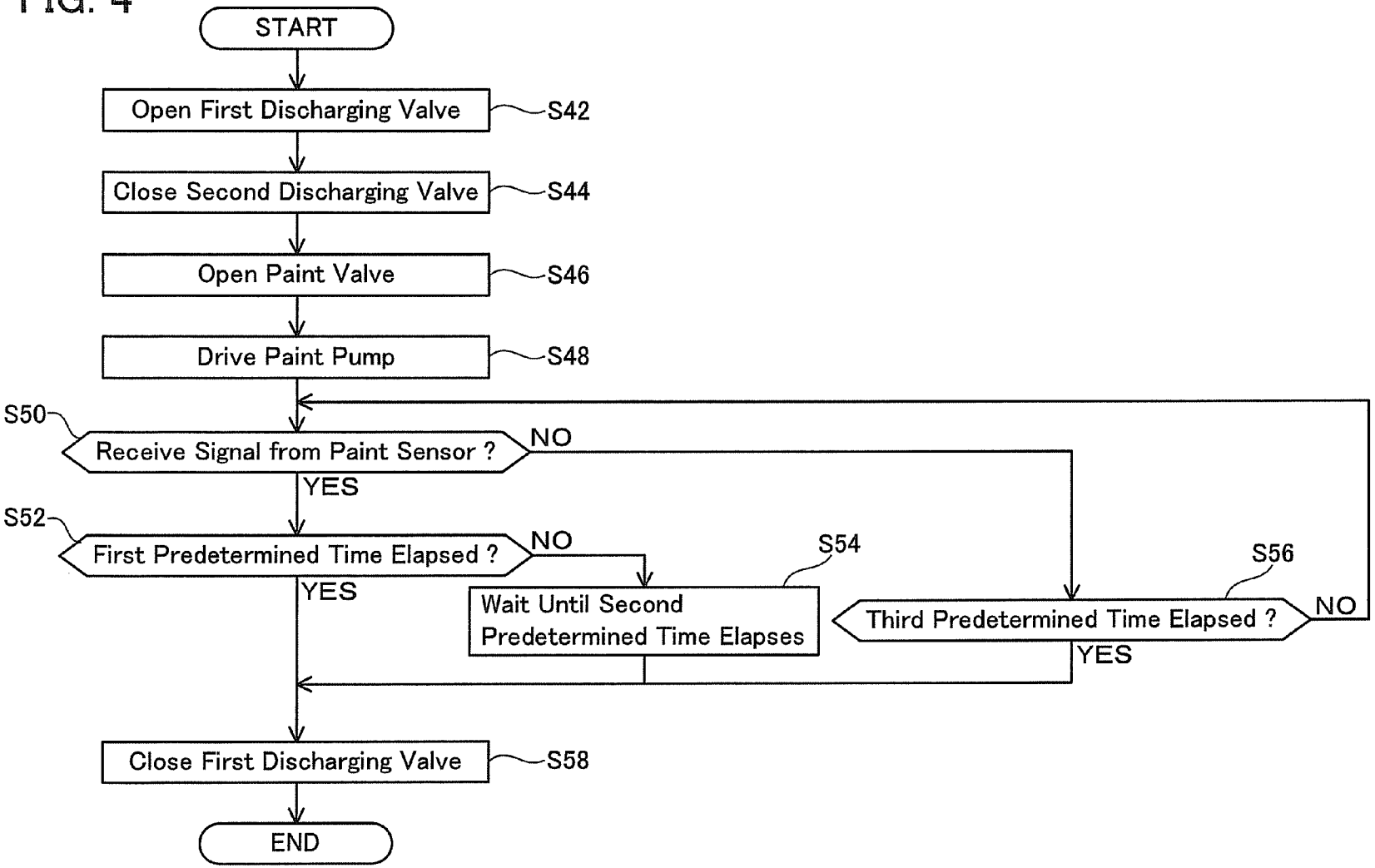
FIG. 4 is a flowchart of a control procedure performed by the controller in an air-releasing process of the present embodiment.
Figure 5:
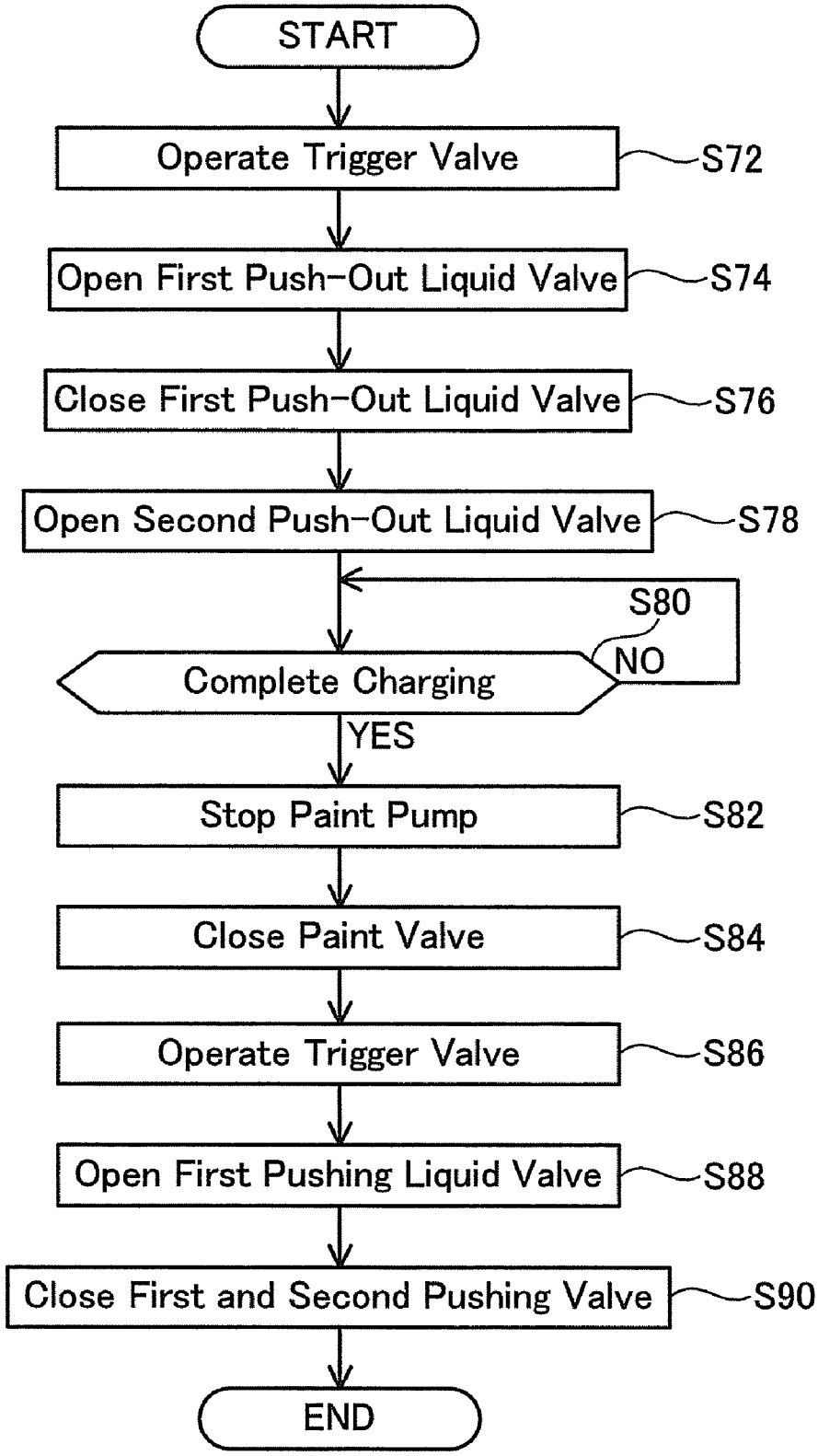
FIG. 5 is a flowchart of a control procedure performed by the controller in a painting material charging process of the present embodiment.

Next, a painting material charging process of the painting material charging device 10 is described. The painting material charging process is carried out subsequent to the washing process. FIG. 4 is a flowchart of a control procedure performed by the controller 80 in the air-releasing process for the painting material supplying path 70, which is carried out in the painting material charging process. FIG. 5 is a flowchart of a control procedure performed by the controller 80 in the painting material charging process for charging to the painting material cartridge 1, which is carried out subsequent to the air-releasing process.

Once the painting material charging process is started, the air-releasing process is carried out first. The controller 80 opens the first discharge valve 46 (step S42). The controller 80 then closes the second discharge valve 44 (step S44) and brings the discharging path 76 into the partially closed state.

Subsequently, the controller 80 opens the painting material valve 26 (step S46), and connects the painting material tank 22 and the painting material supplying path 70 with each other. In a case where the painting material supplying unit 20 is capable of supplying a plurality of types of painting materials, the painting material valve 26 corresponding to the painting material of the attached painting material cartridge 1 is operated. In this case, the other painting material valve 26, the washing liquid valve 28 and the air valve 34 are closed. The controller 80 drives the painting material pump 24 to send the painting material of the painting material tank 22 to the painting material supplying path 70 (step S48). The painting material sent to the painting material supplying path 70 passes through the trigger valve 72 while extruding the air within the painting material supplying path 70, and then flows into the discharging path 76. The painting material that flows into the discharging path 76 is detected by the painting material sensor 42 upon passing through the point where the painting material sensor 42 is disposed. In a case where the paint material sensor 42 detects the painting material within the discharging path 76, the painting material sensor 42 sends a signal to the controller 80. The controller 80 thus confirms the signal from the painting material sensor 42 (step S50). In a case where the controller 80 receives the signal from the painting material sensor 42 (YES in step S50), the controller 80 checks the timer 66, and checks the time elapsed since the painting material pump 24 is driven (step S52). In a case where a first predetermined time (e.g., 0.5 second) or longer has elapsed since the drive of the painting material pump 24 has started (YES in step S52), the step proceeds to step S58. In a case where the first predetermined time has not elapsed since the drive of the painting material pump 24 has started (NO in step S52), the controller 80 waits until a second predetermined time period (e.g., 1.0 second) elapses (step S54), and proceeds to step S58. Note that the first predetermined time may be 0 second. That is, it may be configured so as to prevent conditions where an initial problem occurs in the operation of the painting material sensor 42 and where the painting material remaining in the discharging path 76 is detected from occurring.

On the other hand, when the signal is not received from the painting material sensor 42 (NO in step S50), the controller 80 checks whether or not a third predetermined time (e.g., 1.5 seconds) has elapsed since the drive of the painting material pump 24 has started (step S56). In a case where the third predetermined time has not elapsed since the drive start of the painting material pump 24 (NO in step S56), the step returns to step S50. In a case where the third predetermined time has elapsed since the drive start of the painting material pump 24 (YES in step S56), the step proceeds to step S58. Note that the third predetermined time may be equal to the second predetermined time. Furthermore, the first to third predetermined times may be appropriately changed by the type, humidity and temperature of the painting material.

In step S58, the controller 80 closes the first discharge valve 46 and brings the discharging path 76 into the fully closed state. As a result, the air-releasing process ends.

After the air-releasing process ends, subsequently the painting material charging process is carried out on the painting material cartridge 1. As shown in FIG. 5, the controller 80 operates the trigger valve 72 to connect the painting material supplying path 70 and the painting material flow path 14 with each other, and also to disconnect the painting material supplying path 70 and the discharging path 76 (step S72). Accordingly, the painting materials are charged in the cartridge bag 3 of the painting material cartridge 1. The controller 80 then opens the first extruding-liquid valve 62*a* (step S74). When the painting materials are introduced to the cartridge bag 3 and thereby the volume of the cartridge 3 increases, the extruded liquid or air within the painting material cartridge 1 flows into the first extruding-liquid discharging path 62. The extruded liquid passes through the first extruding-liquid discharging path 62 and flows into the extruding-liquid tank 68.

In a case where a predetermined time (e.g., 3 seconds) elapses after the first extruding-liquid valve 62*a* is brought into the opened state, the controller 80 closes the first extruding-liquid valve 62*a* (step S76), and opens the second extruding-liquid valve 64*a* (step S78). As a result, the extrude liquid within the painting material cartridge 1 is discharged from the lower side of the painting material cartridge (lower side shown in FIG. 1).

The controller 80 confirms whether or not the painting material is charged within the cartridge bag 3 (step S80). For example, confirmation on whether charging of the painting material is completed or not is carried out by sending a signal from a overcharge detection device (not shown) disposed in the painting material cartridge 1 to the controller 80. In a case where the charging of the painting material is completed (YES in step S80), the controller 80 stops the painting material pump 24 (step S82). The controller 80 also closes the painting material valve 26 (step S84) to stop the supply of the painting material. The controller 80 operates the trigger valve 72 (step S86) to disconnect the painting material supplying path 70 and the painting material flow path 14. The controller 80 then opens the first extruding-liquid valve 62*a* (step S88) to adjust the pressure of the painting material cartridge 1. The controller 80 closes the extruding-liquid valves 62*a*, 64*a* after a lapse of a predetermined time (e.g., 0.2 seconds) from the opening of the first extruding-liquid valve 62*a* (step S90), and ends the process. Furthermore, the controller 80 may bring the discharge valves 44, 46 into the opened state for the next washing step.

The painting material which is sent from the painting material tank 22 to the painting material supplying path 70 passes through the inside of the painting material supplying path 70 at high speed. Therefore, the time required for charging the painting material can be reduced. In the air-releasing process of the painting material supplying path 70, the painting material which passes through the painting material supplying path 70 is introduced to the discharging path 76 at high speed. The painting material which is introduced to the discharging path 76 thereby becomes a waste painting material which is not charged in the painting material cartridge 1. In the painting material charging device 10, the painting material sensor 42 is disposed close to the trigger valve 72 of the discharging path 76. For this reason, in the painting material charging device 10, the painting material sensor 42 detects the painting material introduced to the discharging path 76. When the painting material is detected by the painting material sensor 42, the controller 80 closes the discharging path 76 by closing the first discharge valve 46. As a result, introduction of the painting material into the discharging path 76 is stopped, and the amount of waste painting material can be reduced.

For example, in a case where the painting material cannot be detected due to damage in the painting material sensor 42, the painting material sensor 42 cannot detect the painting material, even if the air-releasing the painting material supplying path 70 has ended and the painting material reaches the discharging path 76. Alternatively, in a case where the painting material remains in the painting material supplying path 70, the painting material sensor 42 detects the remaining painting material before the painting material supplied from the painting material tank 22 reaches the discharging path 76. In a case where the air-releasing process is ended at this stage, the air remains in the painting material supplying path 70. In this painting material charging device 10, even though the painting material sensor 42 cannot detect the painting material or falsely detects the painting material, the first discharge valve 46 and the discharging path 76 can be closed by utilizing the timer 66. Thus, even when the painting material sensor 42 cannot detect the painting material properly, the air within the painting material supplying path 70 can surely be removed, and the amount of waste painting material can be reduced.

As described above, in the air-releasing process, the painting material passes through the inside of the discharging path 76 at high speed. As a result, the painting material is introduced to the discharging path 76 between when the painting material is detected by the painting material sensor 42 and when the first discharge valve 46 is closed and the discharging path 76 is fully closed. In this painting material charging device 10, the discharging path 76 is partially closed by the second discharge valve 44 in the air-releasing process. As a result, the air extruded by the painting material can smoothly pass through the partially closed discharging path 76. On the other hand, the flow of the painting material can be interrupted by the partially closed discharging path 76. In other words, the flow rate of the painting material flowing the discharging path 76 slows down. Therefore, the amount of painting material introduced to the discharging path 76 during the time between when the painting material is detected by the painting material sensor 42 and when the first discharge valve 46 is closed can be reduced.

Figure 6:
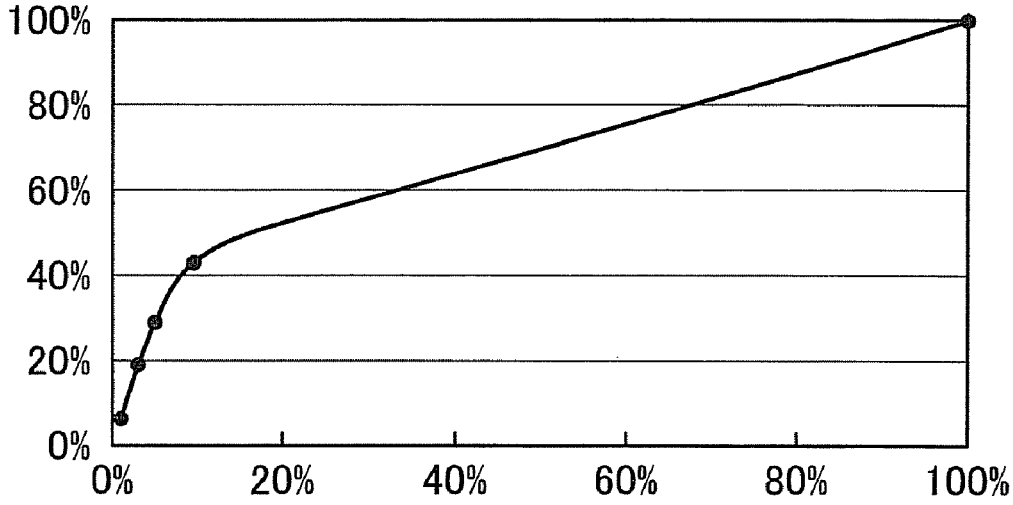
FIG. 6 is a graph showing a relationship between the opening area of a discharging path in a partially closed state of a second discharge valve of the present embodiment and the flow volume of a painting material within a discharging path per unit time.

FIG. 6 is a graph showing a result obtained by changing the opening area in the partially closed state by second discharge valve 44 (the opening area of the partially closed state in relation to the opening area of the fully opened state) to compare the flow rates of the painting material that flows immediately after the second discharge valve 44.

The horizontal axis of FIG. 6 represents the ratio of the opening area of the partially closed discharging path 76 in relation to the opening area of the fully opened discharging path 76. The vertical axis of FIG. 6 represents the ratio of the flow volume of the painting material per unit time in the partially closed state, in relation to the flow volume of the painting material per unit time in the fully opened state. As shown in FIG. 6, the flow volume of the painting material per unit time in the partially closed state can be made equal to or less than half of the flow volume of the painting material per unit time in the fully opened state, by reducing the ratio of the opening area in the partially closed state in relation to the opening area in the fully opened state, to 10%, that is, by reducing the opening area in the partially closed state to 1/10 (one-tenth) or less of the opening area in the fully opened state. That is, by reducing the opening area in the partially closed state to 1/10 or less of the opening area in the fully opened state, the flow rate of the painting material within the discharging path 76 can be reduced more effectively.

Specific embodiments of the present invention are described above, but these merely illustrate some possibilities of the invention and do not restrict the claims thereof. The art set forth in the claims includes variations and modifications of the specific examples set forth above.

The technical elements disclosed in the present specification of the drawings may be utilized separately or in all types of combinations, and are not limited to the combinations set forth in the claims at the time of filing of the application. Furthermore, the technology illustrates in the present specification or the drawings may simultaneously achieve a plurality of objects, and has technological utility by achieving one of those objects.

The invention claimed is:

1. A painting material charging device comprising:

a cartridge attaching unit configured to attach and detach a painting material cartridge;

a painting material supplying path configured to connect with the painting material cartridge attached to the cartridge attaching unit;

a first switching unit configured to switch between connecting and disconnecting the painting material supplying path and the painting material cartridge attached to the cartridge attaching unit;

a painting material supplying unit configured to supply a painting material to the painting material supplying path;

a discharging path configured to connect with the painting material supplying path;

a second switching unit configured to switch the discharging path between a fully opened state and a fully closed state;

a painting material sensor configured to detect the painting material within the discharging path; and a controlling unit configured to be connected to the painting material sensor and the second switching unit, and to cause the second switching unit to fully close the discharging path in a case where the painting material sensor detects the painting material.

2. The painting material charging device as in claim 1, wherein the second switching unit is further configured to switch the discharging path to a partially closed state in which the discharging path is in part closed, and the controlling unit is configured to cause the second switching unit to keep the partially closed state in a case where the painting material supplying path and the painting material cartridge are disconnected by the first switching unit and the painting material sensor does not detect the painting material.

3. The painting material charging device as in claim 2, wherein the second switching unit comprises:

a first valve configured to switch the discharging path between the fully opened state and the fully closed state, and a second valve configured to switch the discharging path between the fully opened state and the partially closed state, wherein the first valve and the second valve are arranged in series on the discharging path.

4. The painting material charging device as in claim 2, wherein an area of the discharging path in the partially closed state by the second switching unit is equal to or smaller than 1/10 of an area of the discharging path in the fully opened state.

5. The painting material charging device as in claim 1, wherein the painting material sensor is located at an upstream side of the second switching unit.

6. The painting material charging device as in claim 1, further comprising:

a washing liquid supplying unit configured to supply washing liquid to the painting material supplying path, wherein the controlling unit is configured to cause the second switching unit to keep the discharging path in the fully opened state while the washing liquid supplying unit is supplying the washing liquid to the discharging path even in a case where the painting material sensor detects the painting material.

7. The painting material charging device as in claim 1, further comprising:

a timer configured to be connected to the controlling unit and to measure a time elapsed from a start of a supplying of the painting material from the painting material supplying unit, wherein the controlling unit is configured to:

cause the second switching unit to switch to the fully closed state when the time measured by the timer becomes a second predetermined time that is longer than a first predetermined time in a case where the painting material sensor has detected the painting material by when the time measured by the timer has become equal to or shorter than the first predetermined time, and cause the second switching unit to switch to the fully closed state in a case where the painting material sensor does not detect the painting material by when the time measured by the timer becomes a third predetermined time that is equal to or longer than the second predetermined time.

* * * * *